United States Patent [19]

Lautenschläger

[11] Patent Number: 5,076,652

[45] Date of Patent: Dec. 31, 1991

[54] DRAWER RAILING

[75] Inventor: Horst Lautenschläger, Reinheim, Fed. Rep. of Germany

[73] Assignee: Karl Lautenschläger GmbH & Co. KG, Reinheim, Fed. Rep. of Germany

[21] Appl. No.: 598,076

[22] Filed: Oct. 16, 1990

[30] Foreign Application Priority Data

Oct. 18, 1989 [DE] Fed. Rep. of Germany ..... 8912349

[51] Int. Cl.[5] ..... A47B 88/00

[52] U.S. Cl. ..... 312/330.1

[58] Field of Search ..... 312/264, 330.1, 348.2

[56] References Cited

U.S. PATENT DOCUMENTS 4,601,523 7/1986 Wenzlick et al. ..... 312/330.1
4,804,239 2/1989 Rock et al. ..... 312/330.1 X
4,872,735 10/1989 Rock et al. ..... 312/330.1

*Primary Examiner*—Joseph Falk

[57] ABSTRACT

Drawer railing having a railing rod to be disposed above and parallel to a drawer side with its front and back end releasably fastened to an associated coupling which can be affixed to the drawer front or drawer back, the rod being adjustable in length at least at one end. The threaded shank of a screw device which can be hung in the associated coupling is driven into at least one end of the railing rod which is of a tubular shape.

8 Claims, 2 Drawing Sheets

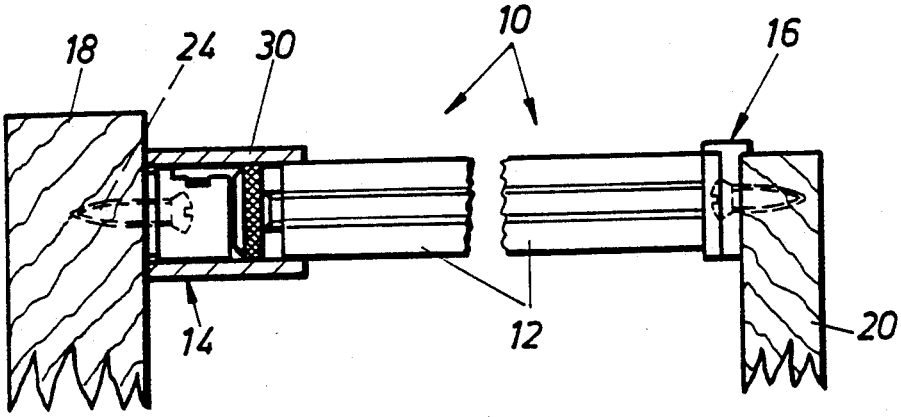
Fig.1
Fig.2
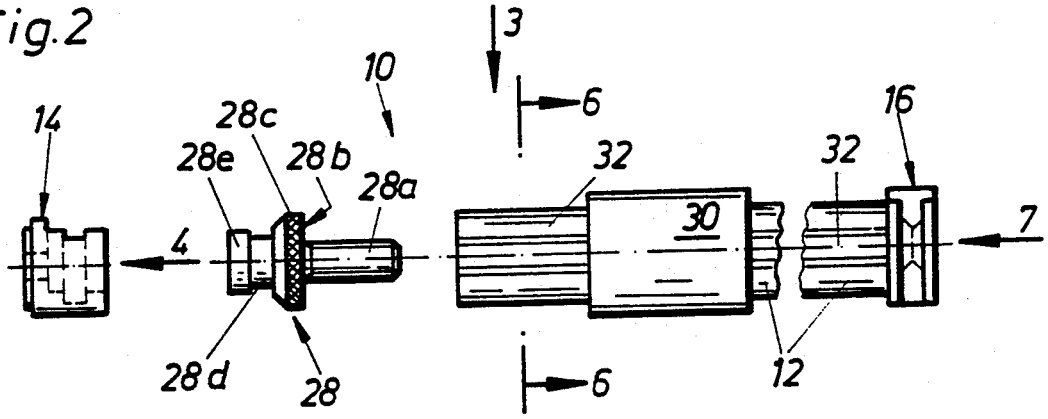
Fig.3
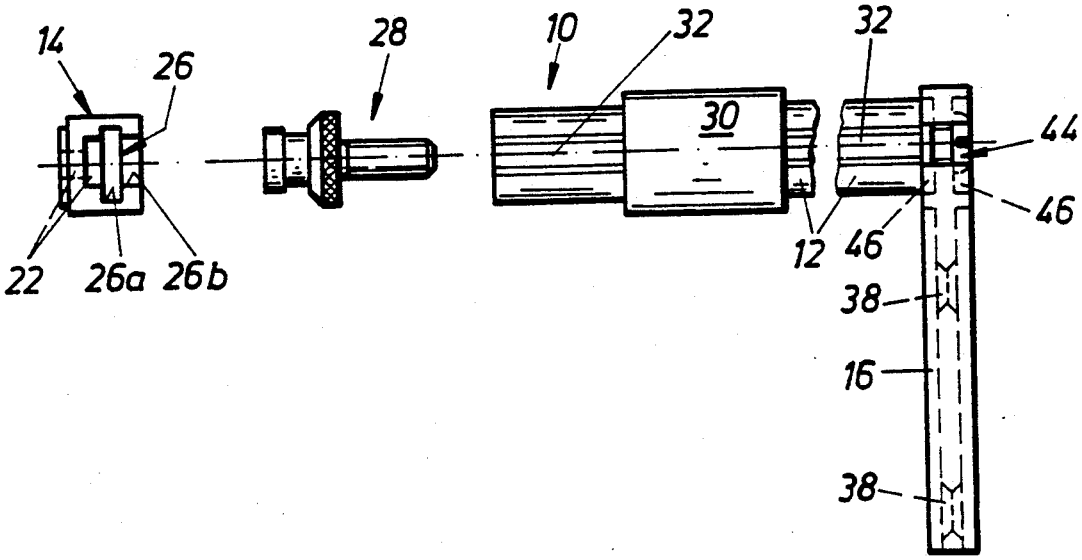

DRAWER RAILING

BACKGROUND OF THE INVENTION

The invention relates to a drawer railing having a railing rod to be disposed parallel to and at a distance above each side of a drawer, with its front and rear ends fastened releasably and for longitudinal adjustment at least at one end to associated coupling devices which can be fastened to the drawer front and to the drawer back, respectively.

In modern furniture construction today, the fronts of drawers are fastened, by means of appropriate hardware, to the drawer sides (and bottoms), usually in an adjustable manner so as to be able to adjust them in regard to alignment with the fronts of adjacent drawers and center them with respect to the side walls of the cabinet. In the case of drawers which are intended to accommodate objects of comparatively great height, frequently only the fronts and backs are made correspondingly high while the sides are of normal height. In these cases at least one railing rod is provided which is fastened parallel to and at a distance above each drawer side to the front and back of the drawer, and together these railings stabilize the drawer.

The invention is addressed to the task of designing such a drawer railing so that the railing rod will be easily and quickly installable and removable, and at the same time will permit any desired adjustments of the drawer front relative to the rest of the drawer-cabinet carcase.

THE INVENTION

Setting out from a drawer railing of the kind described above, this task is accomplished in accordance with the invention in that the threaded shank of a screw device which can be hung in the associated coupling device is driven into at least one end of a railing rod of tubular configuration. By varying the depth to which this threaded shank is driven it is possible to adapt the railing rod to varying distances between the front and back of the drawer.

In a preferred further development of the invention, the screw device has an unthreaded shank section adjacent the threaded shank, and at its free end it has a circularly defined locking disk, and the associated coupling device is provided with an open-mouthed, slot-like recess open at one end into which the locking disk is fitted and which is reduced in its width on the side facing the railing rod to a passage width corresponding to the diameter of the unthreaded section of the shank of the screw device. The locking disk can therefore be hung simply and quickly into the recess in the coupling device through the mouth of the slot-like recess and can be rotated for the adjustment of the length of the railing rod, while the screw device itself is held in the recess against lengthwise displacement.

The lengthwise adjustment of the railing rod is facilitated if the screw device is provided with a radially projecting operating wheel at an axial distance from the locking disk at the transition from the unthreaded section of the shank to the threaded shank. The circumference of the wheel is then best knurled or milled or otherwise roughened to provide a grip.

The coupling device that receives the locking disk has preferably the basic form of a cylinder which can be fastened on the drawer front or back, and has an outside diameter that is about equal to the outside diameter of the railing rod, and a sleeve is disposed on the railing rod for displacement so as to cover the end of the railing rod and the associated coupling device or to release the coupling device. In the position in which it covers the coupling device, therefore, the sleeve serves the dual function of securing the railing rod in the coupling device against unintentional disconnection and of concealing the coupling device including the operating wheel. Thus the adjustment of length by turning the screw device is also possible only when the sleeve is drawn back.

The tube forming the railing rod is, in a preferred further development of the invention, provided with a number of shallow, groove-like depressions running longitudinally and offset angularly from one another, which gives the railing rod an attractive appearance.

Furthermore, it is then possible for the coupling device for the second end of the railing rod to have a mounting bar protruding from the associated drawer back or front, as the case may be, and having an open-ended slot into which the shank of a mounting screw driven into the end of the railing rod can be hung, while in the surface of the mounting bar facing the end of the railing rod a shallow recess can be provided of a shape corresponding to the cross section of the railing rod, in which, when the mounting screw is tightened, the railing rod is then held securely against rotation.

In a preferred further development of the invention, a number of longitudinal ribs reach radially inward from the inside wall of the tube forming the railing rod, their radial height being selected such that their surfaces lie on a common diameter which is smaller than the outside diameter of the spirals of the threaded shank of the screw device. Then the female thread for the screw device or of the mounting screw is formed into the surfaces of the ribs in the ends of the railing rod. This female thread can be created either by cutting it with a thread cutting tool, or, alternatively, the female thread can be produced by the threaded shank of the screw device or mounting screw if the latter is provided with a self-tapping thread.

The tube of which the railing rod is formed is preferably extruded from a light-metal alloy. The railing rod is then made simply by severing sections of the desired length from the tube.

SUMMARY OF THE DRAWINGS

The invention is further explained in the following description of an embodiment in conjunction with the drawing, wherein:

FIG. 1 is a side view of a railing rod fastened in the manner of the invention to the front and back of a drawer, FIG. 2 is a side view of the railing rod and associated coupling hardware, wherein the coupling at the front end and the screw joining the latter to the associated end of the railing rod for longitudinal adjustment are represented disengaged from one another and spread apart, FIG. 3 is a view seen in the direction of arrow 3 in FIG. 2.

DESCRIPTION OF PREFERRED EMBODIMENT

The drawer railing shown in FIGS. 1 to 3 and identified as a whole by 10 includes the railing rod 12 which is to be disposed above and parallel to a drawer side, and whose front and rear end can be fastened each by a coupling 14, 16, to the inside of the front 18 and back 20 of a drawer.

Figure 4:
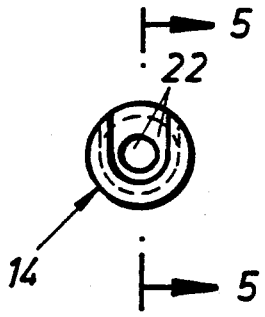
FIG. 4 is a view of the front-end coupling seen in the direction of arrow 4 in FIG. 2.
Figure 5:
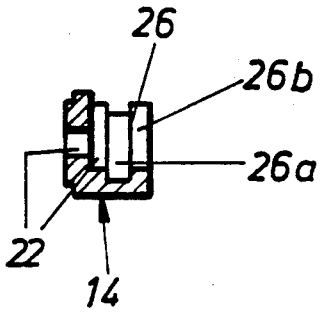
FIG. 5 is a cross section of the coupling taken along the plane indicated by the arrows 5—5 in FIG. 4.

The coupling 14 joining the front end of the railing rod 12 to the drawer front, and represented separately in FIGS. 4 and 5, is basically of cylindrical shape, having a diameter substantially equal to the diameter of the railing rod 12, and which is fastened at one end to the inside of the drawer front [by a screw 24] through a central bore 22 (FIG. 1) of stepped diameter. At a distance from the drawer-front end the bore 22 opens into a groove-like recess 26 running all the way to the circumferential surface of the cylinder and having a width in a first portion 26*a* that is at first slightly larger than the diameter of the section of bore 22 that accommodates the head of the screw 24. Portion 26*a* of the recess is joined by a portion 26*b* of the recess 26, which is reduced in width to about the diameter of the portion of bore 22 that accommodates the head of the screw 24.

The longitudinally adjustable fastening of the drawer-front end of the railing rod 12, i.e., the one situated on the left in FIGS. 1 to 3, to the coupling 14 is accomplished by a screw device 28 (FIGS. 2 and 3) which has a threaded shank 28*a* screwed centrally into the end of the hollow interior of the railing rod 12 and adjoining, in the direction toward the coupling 14, first an adjusting wheel 28*b* having a diameter corresponding to the diameter of the railing rod 12 or of the coupling 14, and whose circumference is knurled at 28*c* to facilitate gripping. The side of the knurled wheel 28*b* facing away from the threaded shank is adjoined by an unthreaded shank section 28*d* whose diameter corresponds substantially to the width of portion 26*b* of the groove-like recess 26, and whose length is approximately equal to the depth of portion 26*a* of recess 26 lengthwise of the coupling 14.

It is apparent that the screw 28 driven with its threaded shank 28*a* into the railing rod 12 can be fastened in the coupling 14 by passing the disk 28*e* through the mouth of portion 26*a*, radially into the recess 26, while the unthreaded shank section 28*d* enters through portion 26*b* of the recess. The securing of the railing rod 12 joined in this manner to the coupling 14 is served by a sleeve 30 which is disposed slidingly on the railing rod 12 and can be moved from the withdrawn position on the railing rod as shown in FIGS. 2 and 3 to a position in abutment against the inside surface of the drawer front, covering in this position the front end of the railing rod 12 and the coupling 14. In this position, therefore, the sleeve 30 keeps the railing rod 12 and the coupling 14 in line with one another and fixes them radially preventing the disk 28*e* from escaping from the recess 26. When the sleeve 30 is drawn back, the length of railing rod 12 can be adjusted relative to the coupling by turning the screw 28, the knurled rim 28*c* of the wheel affording a grip for this purpose.

Figure 6:
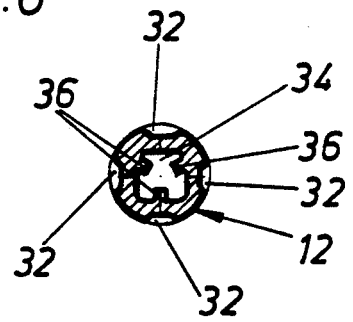
FIG. 6 is a cross section through the railing rod as seen in the direction of arrows 6—6 in FIG. 2.

The railing rod 12, in the case of the railing 10 shown in the drawing, is a section of a tube extruded from a light-metal alloy, whose cross section is shown in FIG. 6. It can be seen that the railing rod has an external profile differing from the circular cross section in that continuous, shallow, groove-like, flat-bottomed depressions 32 are formed in the outer, otherwise circular profile, at 90 degrees apart. It is important only that the railing rod 12 is made attractive in appearance by the groove-like longitudinal depressions and given a cross section which, when fitted into a recess of complementary cross-sectional shape, will prevent rotation of the railing rod relative to the said recess.

Figure 7:
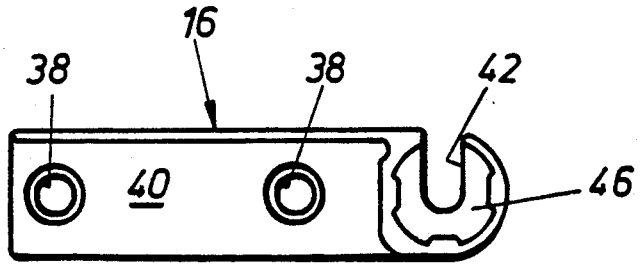
FIG. 7 is a view of the back-end coupling, seen in the direction of arrow 7 in FIG. 2.

To save material and weight, the extruded tube is provided with a bore 34 of relatively great diameter from whose walls three longitudinal ribs 36 project inward radially so that their inside surfaces lie on a common diameter which is smaller than the outside diameter of the threaded shank 28*a* of the screw 28. The female thread to match the thread of shank 28 is therefore created only in the inside surfaces of the ribs 36, and this female thread can be cut either in the conventional manner with a threading tap, or it can be formed by the thread of the shank 28*a* when it is turned for the first time into the railing rod 12. The coupling 16 (FIG. 7) provided for fastening the railing rod 12 to the drawer back 20 consists of a mounting bar 40 provided with two mounting screw holes 38, and having at one cantilevered end section an open-ended slot 42 into which the projecting end of a mounting screw 44 (FIG. 3) not yet fully driven into the associated end of the railing rod 12 can be hung. In the front of the cantilevered section of the mounting bar 40 facing the end of the railing rod 12 that is to be fastened there is provided a shallow recess 46 complementing in shape the cross section of the railing rod 12. By tightening the mounting screw 44 after it has been hung in the slot 42, the end of the railing rod 12 is drawn into the recess 46 and at the same time secured against lifting out of the slot 42 and against rotation relative to the coupling 16. To be able to use this coupling 16 either for fastening a rail rod both over a right-hand drawer side or over a left-hand drawer side, the recess 46 is provided bilaterally on opposite sides of the cantilevered section of the mounting bar 40 and the screw holes 38 are also countersunk on both sides so as to accommodate the head of the screws for fastening the coupling.

I claim:

1. A drawer railing for a drawer, said drawer having sides, said drawer railing including a railing rod disposed parallel to and at a distance above each side of said sides of the drawer, associated couplings, said railing rod including front ends and rear ends, at least one of said ends being releasably fastened, and longitudinally adjusted to one of said associated couplings which can be fastened to a drawer front and to another one of said associated couplings which can be fastened to a drawer back of the drawer, respectively, said drawer railing comprising said at least one end of the railing rod being shaped in the form of a tube, and a threaded shank of a screw device being driven into said at least one end of the railing rod to fasten said railing rod into said coupling so that said railing rod can be hung in the associated coupling, wherein the screw device has an unthreaded shank section adjoining the threaded shank and at the free end thereof a circularly defined locking disk, and the associated couplings each having a slot-like recess open at one end and snugly accommodating the locking disk, the recess being reduced on a side facing the railing rod to a passage width corresponding to the diameter of the unthreaded shank section of the screw device.

2. A drawer railing according to claim 1, wherein the screw device is provided at an axial distance from the locking disk in the transition from the unthreaded shank section to the threaded shank with a radially projecting operating wheel.

3. A drawer railing according to claim 2, wherein the circumferential surface of the operating wheel is knurled, milled or otherwise roughened in a grip improving manner.

4. A drawer railing according to claim 1, wherein the coupling device receiving the locking disk has a basic cylinder shape which can be fastened on the front or back of the drawer, the coupling has an outside diameter and the railing rod has an outside diameter which are approximately equal, and a sleeve is disposed on the railing rod which can be displaced selectively on the railing rod to a position covering the end of the railing rod and the associated coupling and to a position releasing the coupling.

5. A drawer railing according to claim 1, wherein the railing rod is formed of a hollow structural member and is provided with a plurality of shallow, groove-like depressions running longitudinally and offset from one another angularly in the circumferential direction.

6. A drawer railing according to claim 5, wherein the coupling device for the second end of the railing rod has a mounting bar protruding from the associated back or front of the drawer, said mounting bar having a slot open at one end into which a shank of a mounting screw driven from the front end face into the associated end of the railing rod can be hung, and the surface of the mounting bar facing the to-be-fastened end of the railing rod, having a shallow recess defined therein complementary to a cross section of the railing rod.

7. A drawer railing according to claim 5, further comprising longitudinal ribs projecting radially inward from an inner wall of the hollow structural member forming the railing rod, longitudinal ribs each having a radial height selected such that their free faces lie on a common diameter which is smaller than an outside diameter of the thread of the threaded shank of the screw device, and wherein within the face of the longitudinal ribs are formed spirals of a counterthread of the thread of the threaded shank of the screw device, which are provided in the ends of the railing rod.

8. A drawer railing according to claim 5 wherein the hollow structural member forming the railing rod is an extruded shape made from a light metal alloy.

* * * * *